US012221269B1

(12) United States Patent
Veduccio

(10) Patent No.: US 12,221,269 B1
(45) Date of Patent: Feb. 11, 2025

(54) SPRAY CAN BUTTONS FOR PRESSURIZED SPRAY CANS

(71) Applicant: Robert Bruce Veduccio, Marshfield, MA (US)

(72) Inventor: Robert Bruce Veduccio, Marshfield, MA (US)

( * ) Notice: Subject to any disclaimer, the term of this patent is extended or adjusted under 35 U.S.C. 154(b) by 0 days.

(21) Appl. No.: 18/664,781

(22) Filed: May 15, 2024

Related U.S. Application Data

(60) Provisional application No. 63/529,573, filed on Jul. 28, 2023.

(51) Int. Cl.
*B65D 83/20* (2006.01)
*B65D 83/30* (2006.01)

(52) U.S. Cl.
CPC ..... *B65D 83/205* (2013.01); *B65D 83/30* (2013.01)

(58) Field of Classification Search
CPC ..... B65D 83/205; B65D 83/30
See application file for complete search history.

(56) References Cited

U.S. PATENT DOCUMENTS 2,831,618 A * 4/1958 Soffer ..... B65D 83/46 222/402.24
3,211,384 A * 10/1965 Seaquist ..... B65D 83/22 239/573
3,249,260 A * 5/1966 Goldberg ..... B65D 83/205 222/153.1
3,314,576 A * 4/1967 Richard ..... B65D 83/205 222/541.6
3,325,054 A * 6/1967 Braun ..... B65D 83/226 251/95
3,913,842 A * 10/1975 Singer ..... B65D 83/30 222/402.12
4,401,271 A * 8/1983 Hansen ..... B65D 83/303 239/592
4,401,272 A * 8/1983 Merton ..... B65D 83/303 239/592

(Continued)

FOREIGN PATENT DOCUMENTS

AU 2005311612 A1 6/2006
CN 201961694 U 9/2011

(Continued)

*Primary Examiner* — Frederick C Nicolas
(74) *Attorney, Agent, or Firm* — John Rizvi; John Rizvi, P.A.—The Patent Professor®

(57) ABSTRACT

Improved replacement spray can buttons configured for removable installation on pressurized aerosol spray cans, include an integral stem, a hose adapter and an improved integral pin-point spray nozzle. Portions of the button may be injection molded. The improved nozzle provides a direct pin-point spray without the need of a straw, or red hose accessory provided with many spray lubricants. The button includes a tapered orifice and a tapered interior lumen. The button may beneficially be used to securely hold a hose accessory if desired, so it will not fall out during use. The button may accommodate the same size stem or orifice of existing spray cans, and be used as a replacement button for any suitable spray products. The button may be used by (Continued)

manufacturers and consumers to replace the button currently provided with such products, and may be installed in place of the existing button at the same location.

5 Claims, 9 Drawing Sheets

(56) References Cited

U.S. PATENT DOCUMENTS 5,388,730 A * 2/1995 Abbott ..... B65D 83/205 222/321.2
5,934,518 A * 8/1999 Stern ..... B05B 1/1645 222/402.1
6,328,185 B1 * 12/2001 Stern ..... B65D 83/753 239/394
6,595,393 B1 * 7/2003 Loghman-Adham ..... B65D 83/22 222/153.14
6,837,401 B2 * 1/2005 Groys ..... B05B 15/40 222/402.1
6,981,616 B2 * 1/2006 Loghman-Adham ..... B65D 83/22 222/153.14
7,044,338 B2 * 5/2006 Roden ..... B65D 83/303 222/402.1
7,300,001 B2 * 11/2007 Kuo ..... A61M 11/00 239/487
7,334,427 B2 2/2008 Ozaki et al.
7,845,523 B1 * 12/2010 Greer, Jr. ..... B65D 83/30 222/402.1
8,459,279 B1 * 6/2013 Jermyn ..... B65D 83/30 134/167 C
8,701,944 B2 * 4/2014 Tryon ..... B05D 5/061 222/394
8,985,392 B2 * 3/2015 Greer, Jr. ..... B05B 15/652 222/402.1
9,555,953 B2 * 1/2017 Baudin ..... A61Q 15/00
10,479,592 B1 * 11/2019 Caruso ..... B05B 15/62
10,661,973 B1 * 5/2020 Caruso ..... B65D 83/205
2003/0127468 A1 * 7/2003 Loghman-Adham ..... B65D 83/22 222/153.14
2005/0150910 A1 * 7/2005 Groys ..... B65D 83/38 222/189.11
2019/0247867 A1 * 8/2019 Morrison ..... B65D 83/30

FOREIGN PATENT DOCUMENTS

DE 102004057704 A1 6/2006
ES 2784540 T3 9/2020
WO 1995025052 A1 9/1995

* cited by examiner

SPRAY CAN BUTTONS FOR PRESSURIZED SPRAY CANS

CROSS-REFERENCE TO RELATED APPLICATIONS

This application claims the benefit of U.S. Provisional Patent Application Ser. No. 63/529,573, filed on Jul. 28, 2023, which is incorporated by reference herein in its entirety.

FIELD OF THE INVENTION

The present invention relates generally to spray can nozzles, and more particularly to improved spray can buttons for use with pressurized spray cans.

BACKGROUND OF THE INVENTION

There have been functional problems with spray can nozzles and spray can buttons for pressurized spray cans since the invention of pressurized spray cans. Attempts to solve this problem have been unsuccessful.

It is commonly known that WD-40 brand lubricant aerosol cans include a nozzle that is complicated to use, which easily clogs, causing the lubricant to sputter. The hose accessory that is provided with the product is not able to be securely retained in the nozzle, causing more difficulties in use and delivery of the lubricant product. Other lubricant products like Liquid Wrench brand lubricant are complicated to use for the same reason. The hose accessory frequently falls out and is usually unable to be retrieved.

Some attempts, related to spraying paint, have included the use of an AC utility power source provided by a power cord connected to an external activator and an internal armature movable armature to operate a valve assembly connected to a spray head. The valve assembly remains closed when the armature is not energized by the external activator to prevent the flow of paint. The valve assembly remains closed until the armature is energized by the activator to open the valve assembly to permit paint to be sprayed when the spray head is depressed. Options like this are complicated and require AC power, and are unsuitable for aerosol cans.

Another option which presents an unsuccessful solution for an aerosol can, is related to a refrigeration machine ejector with an elongated nozzle for propelling a refrigerant in machine applications with an ejection cycle subjected to a thermal load. The elongated ejector includes an elongated tapered nozzle and an interior tapered needle. The elongated tapered nozzle has an inner passage with a radial dimension reduced toward a nozzle outlet port, with an elongated needle having a needle tapered section disposed in the inner passage. The needle tapered section has a cross sectional area reduced toward a downstream end of the needle, and the downstream end of the needle is positioned at a downstream side with respect to the outlet port of the elongated nozzle. In addition, to meet operating conditions of the refrigeration machine, the nozzle tapered section requires a taper angle ($\varphi 1$) which is equal to or greater than a taper angle ($\varphi 2$) of the needle tapered section. Therefore, a boundary face on the outside of a nozzle jet flow becomes in a balanced natural shape and is controlled in accordance with an operating condition. Thus, the ejector cycle of the refrigeration machine can be operated while keeping high efficiency, regardless of the thermal load of the ejector cycle. Again, this electrical option is complicated and unsuitable for an aerosol can.

Another unsuitable option relates to an electric, battery operated fluid product distribution device, which comprises an interface structure and a shell coupled with the interface structure. The interface structure is coupled with a container filled with a fluid product and comprises an interface base and a lock ring, the shell comprises an upper shell body and a lower shell body, the lower shell body is directly coupled with the lock ring of the interface structure, the upper shell body is coupled in a way of rotating relative to the lower shell body, one of the upper shell body and the lower shell body is provided with a plurality of protruding parts at the coupling end of the upper shell body and the lower shell body, the other shell body is provided with corresponding matching parts, the protruding parts and the matching parts are arranged in concentric circles or with the axial lines in parallel or mutually superimposed, and when the upper shell body and the lower shell body are coupled together, the protruding parts can be matched with the matching parts, so that the upper shell body can rotate relative to the lower shell body around the rotating axial line of the center of the concentric circles or around the parallel axial lines or the superimposed axial lines, and the vertical movement of the upper shell body and the lower shell body can be limited. In addition, the lock ring comprises an elastic lock ring clamping part which can move back and forth along the radial direction of the lock ring, and when the elastic lock ring clamping part is not compressed, the elastic lock ring clamping part is flush with the inner peripheral edge of the lock ring or lower than the inner peripheral edge of the lock ring. Again, this electrical battery operated option is complicated and unsuitable for an aerosol can.

One option includes an aerosol/spray can cap with an integral button including a folded acoustic seal at the button and an elastic link between the integral button that includes no tapered portion. This options also fails to solve the problem of clogging and sputtering.

Ideally, it would be extremely useful to be able to attach to the container a simple device which imparts directionality to a spray or stream from an aerosol spray can, without causing clogging or sputtering and remains attached to the aerosol can during use. Further it would be useful for such a device being capable of receiving and securely holding an accessory hose should the user decide to use one.

Accordingly, there is a need for a solution to at least one of the aforementioned problems.

SUMMARY OF THE INVENTION

The present invention provides removable spray can buttons for use on pressurized aerosol spray cans.

In a first implementation, a removable spray can button for use on a pressurized spray can comprises a spray can button body having a top, a bottom, at least one side wall, an exterior surface, and an interior portion comprising a tapered interior lumen and at least one tapered orifice comprising a first upper tapered orifice and a second lower tapered orifice. The button comprises an improved nozzle configured to provide a direct pinpoint spray; an integral hose adapter defined by the first tapered orifice configured to receive and securely retain a spray hose; and an integral stem connector carried by and extending outward from the button body, the integral stem connector comprising the second lower tapered orifice configured for connection to a pressurized spray can. The first upper tapered orifice terminates in the improved nozzle. The spray can button is configured for installation at a top center area of an aerosol can in place of an existing aerosol can button to provide a targeted spray.

In one aspect, the spray can button is configured for removable placement on a pressurized spray can.

In one aspect, the spray button includes an integral stem, and an improved spray nozzle.

In one aspect, the spray button provides an integral hose adapter configured to receive and retain a hose accessory.

In one aspect, the spray button may be used as a replacement spray can button with any suitable spray product, including but not limited to spray lubricants or the like.

In one aspect, the improved nozzle of the spray button comprises an integral pin-point spray nozzle capable of providing a direct pin-point spray without the need of a straw, such as a standard red hose accessory commonly provided with many spray lubricants for a direct pin-point spray.

In one aspect, the spray button may include a tapered orifice and a tapered interior lumen. The tapered orifice and tapered lumen may beneficially be used to securely hold the hose accessory. If the user needs a longer reach, the hose accessory may be more securely attached to the spray can nozzle by insertion into the tapered orifice and will not fall out during use.

In one aspect, the spray button of the present invention may be installed at the top center of an aerosol can in place of an existing button.

In one aspect, the integral stem connector comprises and is integral with the second lower tapered orifice configured for connection to a pressurized spray can. The spray button is configured for installation on a pressurized spray can or an aerosol can at a top center area on an exit valve of the aerosol can.

In one aspect, the integral stem connector may comprise an elongated hollow stem configured to be inserted in the exit valve of the spray can to install the button.

In a second implementation, the integral stem connector may comprise a hollow stem configured to be installed over the exit valve of the spray can to install the button.

In a third implementation, integral stem connector may comprise an elongated hollow stem configured to be inserted in the exit valve of the spray can to install the button, and may further comprise an exterior donut-shaped protrusion, which may both serve as a stem support to stabilize the stem and hold it in place during use of the pressurized spray can, and prevent the stem from being overinserted in the exit valve of the can. The donut-shaped protrusion located proximal to where the stem meets the valve makes it less likely that the stem will break off at that junction in response to too much horizontal force being accidentally applied to the button, or when the can on which the button is installed accidentally falls or is accidentally dropped.

In a fourth implementation, the integral stem connector may comprise a hollow tubular stem configured to be installed over the exit valve of the spray can, to install the button, and may further comprise an exterior donut shaped protrusion which may serve as a stem support to stabilize the stem and hold it in place during use of the pressurized spray can. In use, the donut-shaped protrusion is proximal to where the stem meets the valve and makes it less likely that the stem will break off at that junction in response to too much horizontal force being accidentally applied to the button, or when the can on which the button is installed accidentally falls or is accidentally dropped.

In a fifth implementation, the button body may comprise at least one side wall having an ergonomic shape with a larger lower portion tapering inward to a relatively smaller upper portion. The at least one side wall may include a wide cupped ergonomic depression configured to comfortably receive and support a user's finger when the button is depressed. The integral stem connector may comprise an elongated hollow stem configured to fit into a spray can valve as described herein. The button may further comprise a retention collar configured to snap fit over an upper rim of a spray can. The retention collar may comprise an upper flange which extends over the bottom of the button body and is configured to retain the button body in place. The retention collar further comprises a lower rim configured to snap fit over the spray can upper rim to further secure the button body in place on the spray can. In use, the retention collar permits the button body to be depressed while stabilizing the button body to prevent damage to the can exit valve.

In a sixth implementation, the button body may comprise at least one side wall having an ergonomic shape with a larger lower portion tapering inward to a relatively smaller upper portion. The at least one side wall may include a wide cupped ergonomic depression configured to comfortably receive and support a user's finger when the button is depressed. The integral stem connector may comprise a hollow tubular stem configured to fit over a spray can valve as described herein. The button may further comprise a retention collar configured to snap fit over an upper rim of a spray can. The retention collar may comprise an upper flange which extends over the bottom of the button body and is configured to retain the button body in place. The retention collar further comprises a lower rim configured to snap fit over the spray can upper rim to further secure the button body in place on the spray can. In use, the retention collar permits the button body to be depressed while stabilizing the button body to prevent damage to the can exit valve.

In one aspect, the spray button may be manufactured to accommodate the same size stem or orifice that now exists on various spray products. The spray button of the present invention may be used by the aerosol companies and/or by consumers to replace any spray button that currently comes with spray products.

In one aspect, the novel spray can buttons of the present invention are configured for removable installation on conventional pressurized spray cans. The spray can buttons may be used as a replacement spray can button with products such as WD-40 brand spray lubricant, Liquid Wrench brand lubricant, any other similar spray lubricant, or like spray product which may require or benefit from a targeted spray.

In one aspect, the spray button(s) of the present invention or portions thereof may be injection molded. In some embodiments, the spray button may be one integral piece. In other embodiments, portions of the spray button may be injection molded.

In one aspect, no electrical components are required for operation or use of the spray buttons of the present invention.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1A:
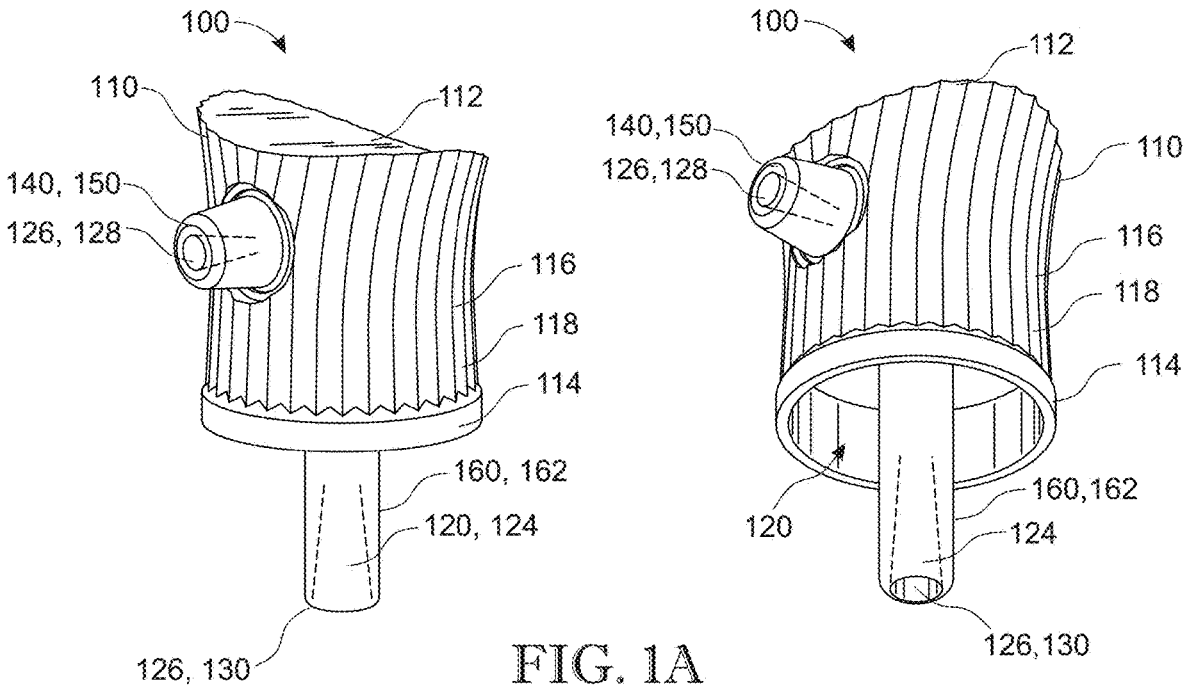
FIG. 1A presents a front right perspective view and a front right bottom perspective view of a removable spray can button in accordance with a first illustrative embodiment of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1A. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward spray can buttons for removable placement on pressurized spray cans. The spray can buttons include an integral stem, and an improved spray nozzle. The buttons further provide an integral hose adapter. The spray can buttons may be used as replacement spray can buttons with any suitable spray products, including but not limited to spray lubricants or the like.

The improved nozzle of a spray can button in accordance with the present invention comprises an integral pin-point spray nozzle capable of providing a direct pin-point spray without the need of a straw, such as a standard red hose accessory commonly provided with many spray lubricants for a direct pin-point spray. The spray can button may include a tapered orifice and a tapered interior lumen. The tapered orifice and tapered lumen may beneficially be used to securely hold the hose accessory. If the user needs a longer reach, the hose accessory may be more securely attached to the spray can nozzle by insertion into the tapered orifice and will not fall out during use.

The spray button of the present invention may be installed at the top center of an aerosol can in place of an existing button.

The spray button of the present invention may be integrally molded. The spray button of the present invention may be injection molded. The spray button of the present invention may be manufactured to accommodate the same size stem or orifice that now exists on various spray products. The spray button of the present invention may be used by the aerosol companies and/or by consumers to replace any spray button that currently comes with spray products.

Figure 2:
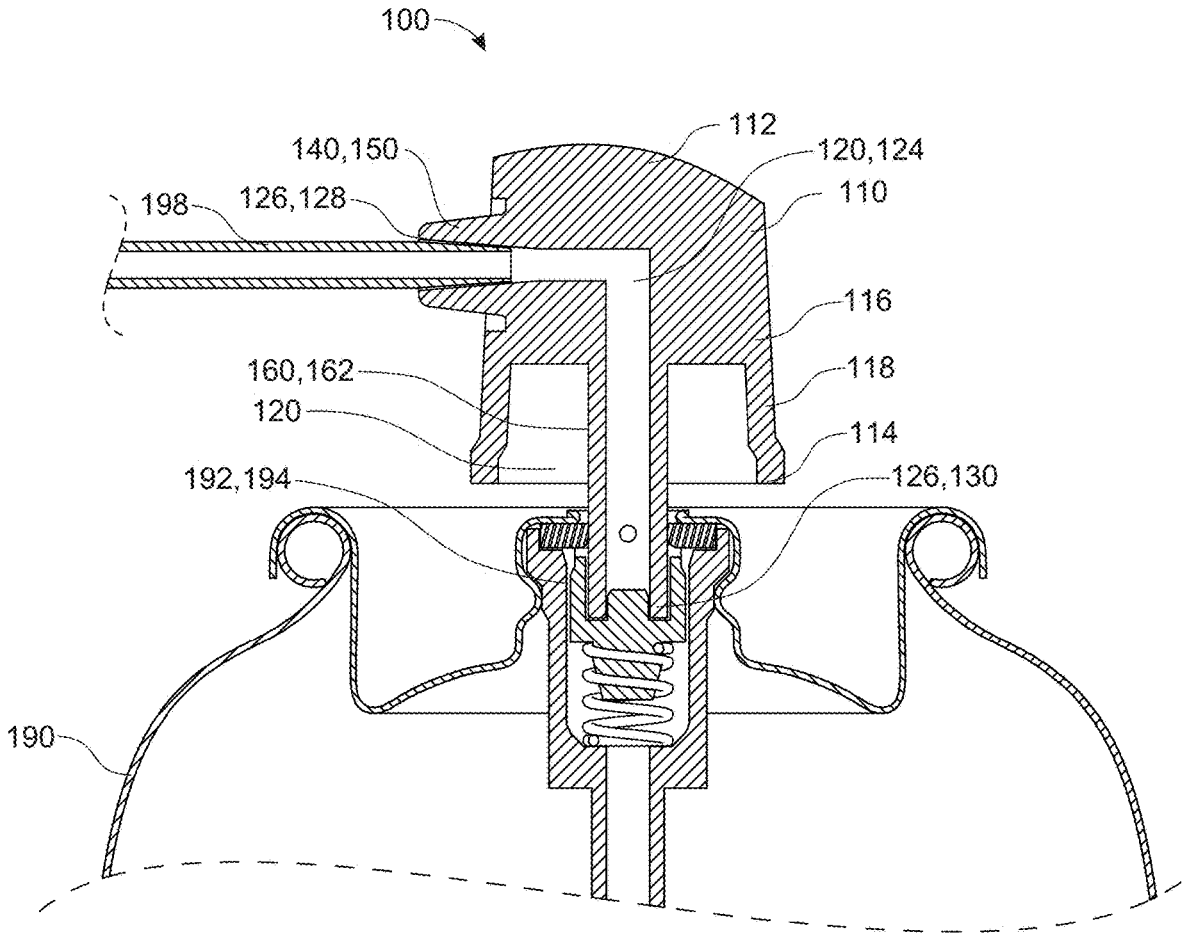
FIG. 2 presents a side cross-section view of a removable spray can button as in FIG. 1A, with the removable spray can button installed on a representative spray can, and showing an optional hose accessory installed therein.

Referring initially to FIG. 1A, a right perspective view and a front right bottom perspective view are provided of a removable spray can button, hereinafter button 100, in accordance with a first illustrative embodiment of the present invention. FIG. 2 presents a side cross-section view of a removable spray can button as in FIG. 1A, with the removable spray can button installed on a representative spray can, and showing an optional hose accessory installed therein. The button 100 is configured for use on a pressurized spray can (as seen at FIG. 2, elements 190,194). The button 100 comprises a spray can button body 110 having a top 112, a bottom 114, at least one side wall 116, an exterior surface 118, and an interior portion 120 comprising a tapered interior lumen 124 and at least one tapered orifice 126 comprising a first upper tapered orifice 128 and a second lower tapered orifice 130. The first and second tapered orifices 128,130 are in fluid communication with the tapered interior lumen 124, with the tapered interior lumen 124 extending therebetween. The at least one side wall may be any suitable number of side walls, as the geometric shape may be any suitable shape. The at least one side wall shown is one cylindrical side wall.

The removable spray can button 100 comprises an improved nozzle 140 configured to provide a direct pinpoint spray; an integral hose adapter 150 defined by the first tapered orifice configured to receive and securely retain a spray hose; and an integral stem connector 160 carried by and extending outward from the button body 110.

The first upper tapered orifice 128 terminates in and is integral with the improved nozzle 140.

The integral stem connector 160 comprises and is integral with the second lower tapered orifice 130 configured for connection to a pressurized spray can. The spray can button 100 is configured for installation on a pressurized spray can or an aerosol can 190 at a top center area 192 on an exit valve 194 of the aerosol can 190 as shown at FIG. 2. The integral stem connector 160 of the button 100 comprises an elongated hollow stem 162 configured to be inserted in the exit valve 194 to install the button 100.

The button 100 is configured for use to provide a to provide a targeted spray. Optionally, the button 100 may be used with a hose accessory 198, which may be inserted in the tapered orifice 128 and securely held therein.

Figure 1B:
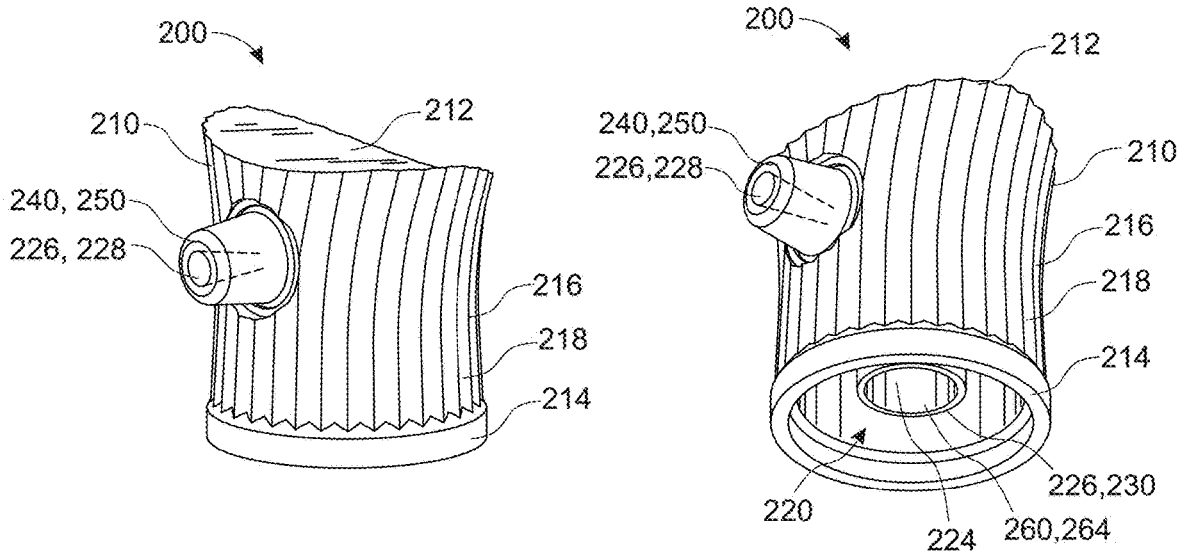
FIG. 1B presents a front right perspective view and a front right bottom perspective view of a removable spray can button in accordance with a second illustrative embodiment of the present invention.
Figure 3:
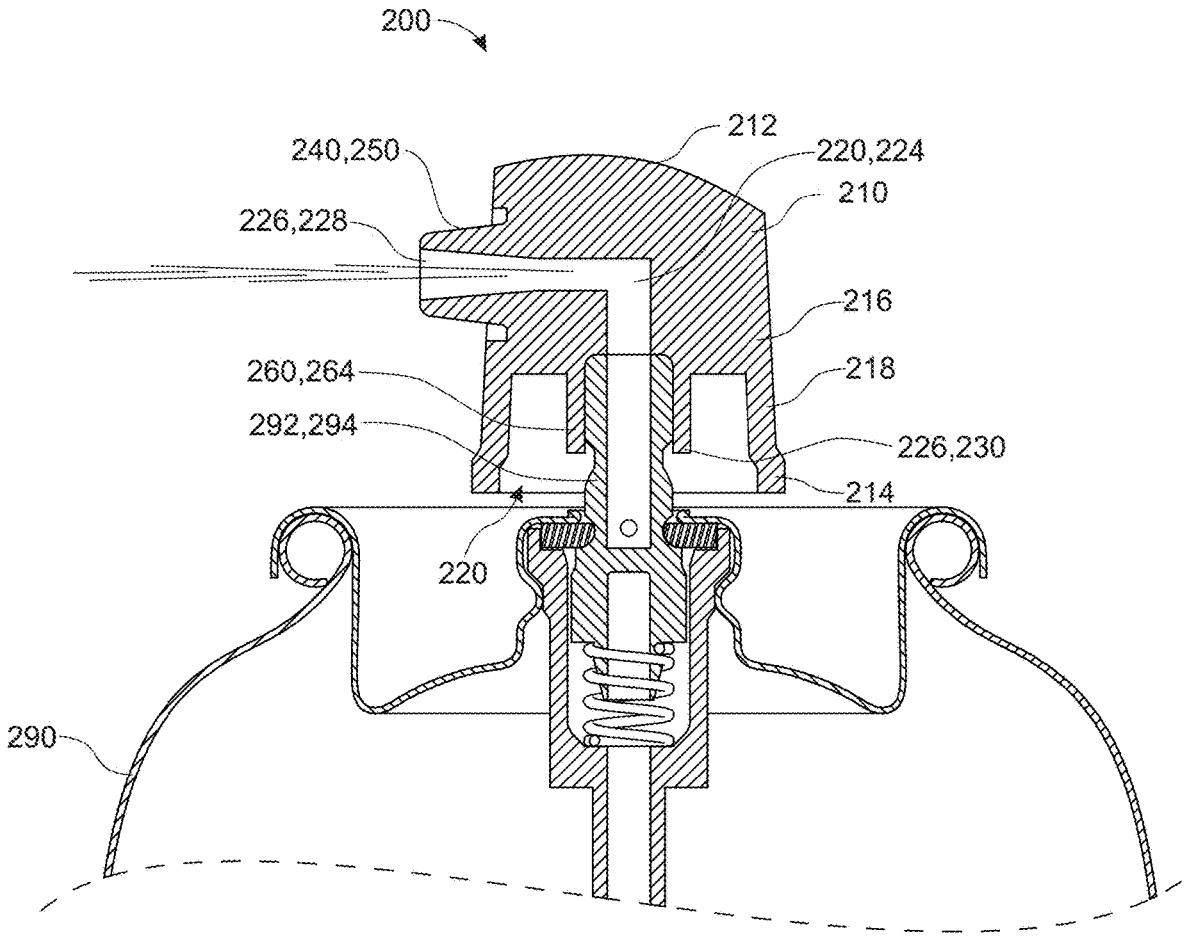
FIG. 3 presents a side cross-section view of a removable spray can button as in FIG. 1B, with the removable spray can button installed on a representative spray can.

Referring next to FIG. 1B, a front right perspective view and a front right bottom perspective view are providing showing a removable spray can button 200 in accordance with a second illustrative embodiment of the present invention. FIG. 3 presents a side cross-section view of a removable spray can button as in FIG. 1B, with the removable spray can button installed on a representative spray can. Reference numerals which correspond to like elements of the button 100 heretofore described with respect to FIGS. 1A and 2 are designated by the same reference numerals in the 200-299 series in FIGS. 1B and 3.

The button 200 is configured for use on a pressurized spray can (as seen at FIG. 3, elements 290,294). The button 200 comprises a spray can button body 210 having a top 212, a bottom 214, at least one side wall 216, an exterior surface 218, and an interior portion 220 comprising a tapered interior lumen 224 and at least one tapered orifice 226 comprising a first upper tapered orifice 228 and a second lower tapered orifice 230. The first and second tapered orifices 228,230 are in fluid communication with the tapered interior lumen 224, with the tapered interior lumen 224 extending therebetween. The at least one side wall may be any suitable number of side walls, as the geometric shape may be any suitable shape. The at least one side wall shown is one cylindrical side wall.

The removable spray can button 200 comprises an improved nozzle 240 configured to provide a direct pinpoint spray; an integral hose adapter 250 defined by the first tapered orifice configured to receive and securely retain a spray hose; and an integral stem connector 260 carried by and extending outward from the button body 210.

The first upper tapered orifice 228 terminates in and is integral with the improved nozzle 240.

The integral stem connector 260 comprises and is integral with the second lower tapered orifice 230 configured for connection to a pressurized spray can. The spray can button 200 is configured for installation on a pressurized spray can or an aerosol can 290 at a top center area 292 on an exit valve 294 of the aerosol can 290 as shown at FIG. 3. The integral stem connector 260 of the button 200 comprises a hollow tubular stem 264 configured to be installed over the exit valve 294 to install the button 200.

The button 200 is configured for use to provide a to provide a targeted spray. Optionally, the button 200 may be used with a hose accessory, which may be inserted in the tapered orifice 228 and securely held therein (as is shown in FIG. 3 wherein a hose accessory 198 has been inserted in the tapered orifice 128 and is being securely held therein).

Figure 4A:
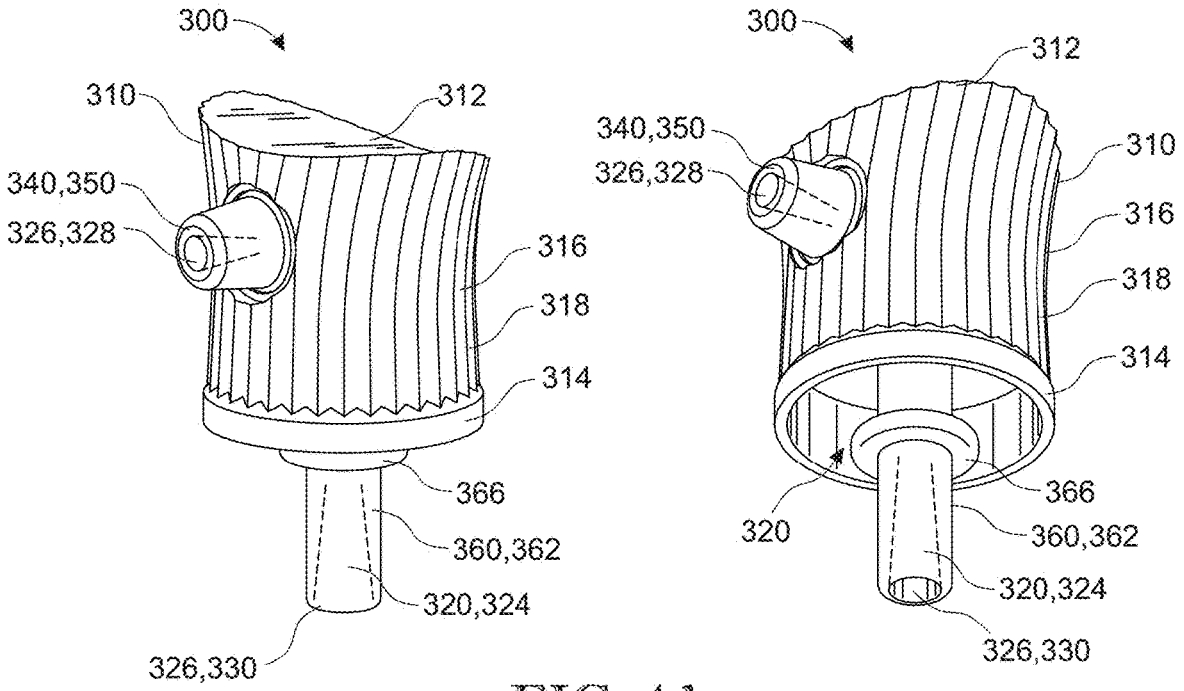
FIG. 4A presents a front right perspective view and a front right bottom perspective view of a removable spray can button in accordance with a third illustrative embodiment of the present invention.
Figure 5:
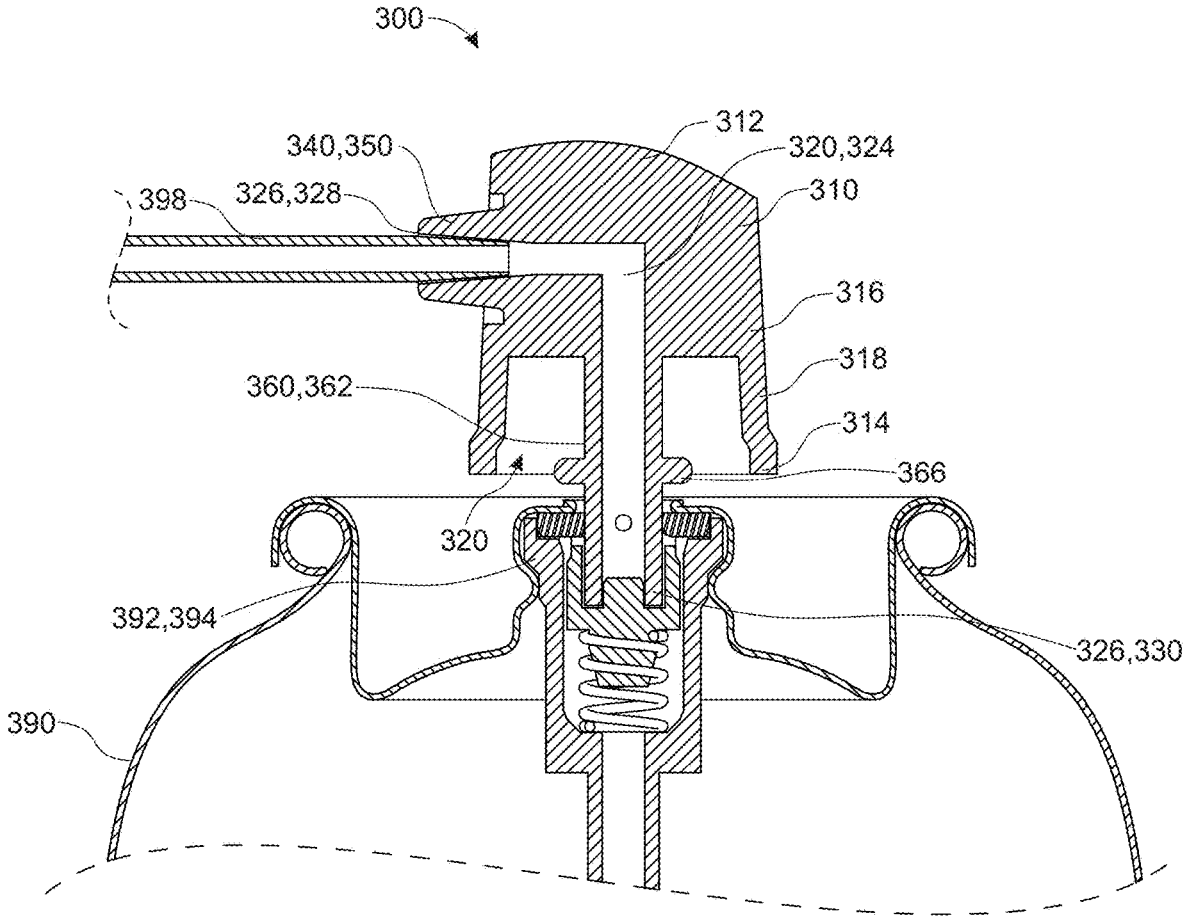
FIG. 5 presents a side cross-section view of a removable spray can button as in FIG. 4A, with the removable spray can button installed on a representative spray can, and showing an optional hose accessory installed therein.

Referring now to FIG. 4A, a right perspective view and a front right bottom perspective view are provided of a removable spray can button, hereinafter button 300, in accordance with a third illustrative embodiment of the present invention. FIG. 5 presents a side cross-section view of a removable spray can button as in FIG. 4A, with the removable spray can button installed on a representative spray can, and showing an optional hose accessory installed therein. Reference numerals which correspond to like elements of the button 100 heretofore described with respect to FIGS. 1A and 2, and the button 200 heretofore described with respect to FIGS. 1B and 3, are designated by the same reference numerals in the 300-399 series in FIGS. 4A and 5.

The button 300 is configured for use on a pressurized spray can (as seen at FIG. 5, elements 390,394). The button 300 comprises a spray can button body 310 having a top 312, a bottom 314, at least one side wall 316, an exterior surface 318, and an interior portion 320 comprising a tapered interior lumen 324 and at least one tapered orifice 326 comprising a first upper tapered orifice 328 and a second lower tapered orifice 330. The first and second tapered orifices 328,330 are in fluid communication with the tapered interior lumen 324, with the tapered interior lumen 324 extending therebetween. The at least one side wall may be any suitable number of side walls, as the geometric shape may be any suitable shape. The at least one side wall shown is one cylindrical side wall.

The removable spray can button 300 comprises an improved nozzle 340 configured to provide a direct pinpoint spray; an integral hose adapter 350 defined by the first tapered orifice configured to receive and securely retain a spray hose; and an integral stem connector 360 carried by and extending outward from the button body 310.

The first upper tapered orifice 328 terminates in and is integral with the improved nozzle 340.

The integral stem connector 360 comprises and is integral with the second lower tapered orifice 330 configured for connection to a pressurized spray can. The spray can button 300 is configured for installation on an aerosol can 390 at a top center area 392 on an exit valve 394 of the pressurized spray can or aerosol can 390 as shown at FIG. 5. The integral stem connector 360 of the button 300 comprises an elongated stem 362 configured to be inserted in the exit valve 394 to install the button 300.

The elongated stem 362 may further comprise an exterior donut-shaped protrusion 366, which may both serve as a stem support to stabilize the stem 362 and hold it in place during use of the pressurized spray can 390, and prevent the stem 362 from being overinserted in the exit valve 394 of the can 390. The donut-shaped protrusion 366 located proximal to where the stem meets the valve 394 makes it less likely that the stem 362 will break off at that junction in response to too much horizontal force being accidentally applied to the button 300, or when the can 390 on which the button 300 is installed accidentally falls or is accidentally dropped.

The button 300 is configured for use to provide a to provide a targeted spray. Optionally, the button 300 may be used with a hose accessory 398, which may be inserted in the tapered orifice 328 and securely held therein.

Figure 4B:
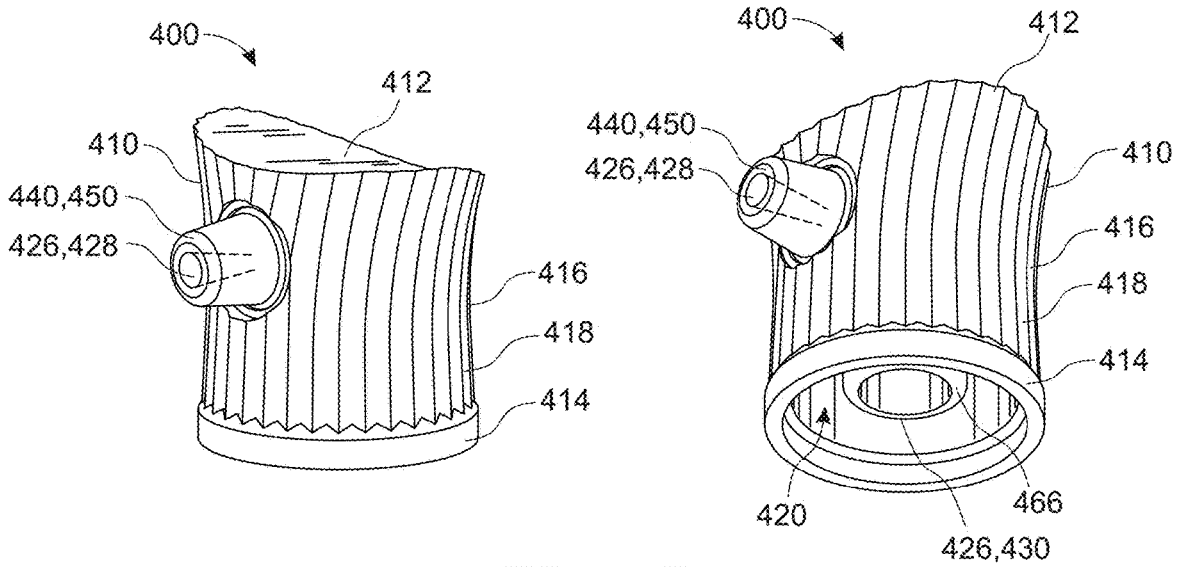
FIG. 4B presents a front right perspective view and a front right bottom perspective view of a removable spray can button in accordance with a fourth illustrative embodiment of the present invention.
Figure 6:
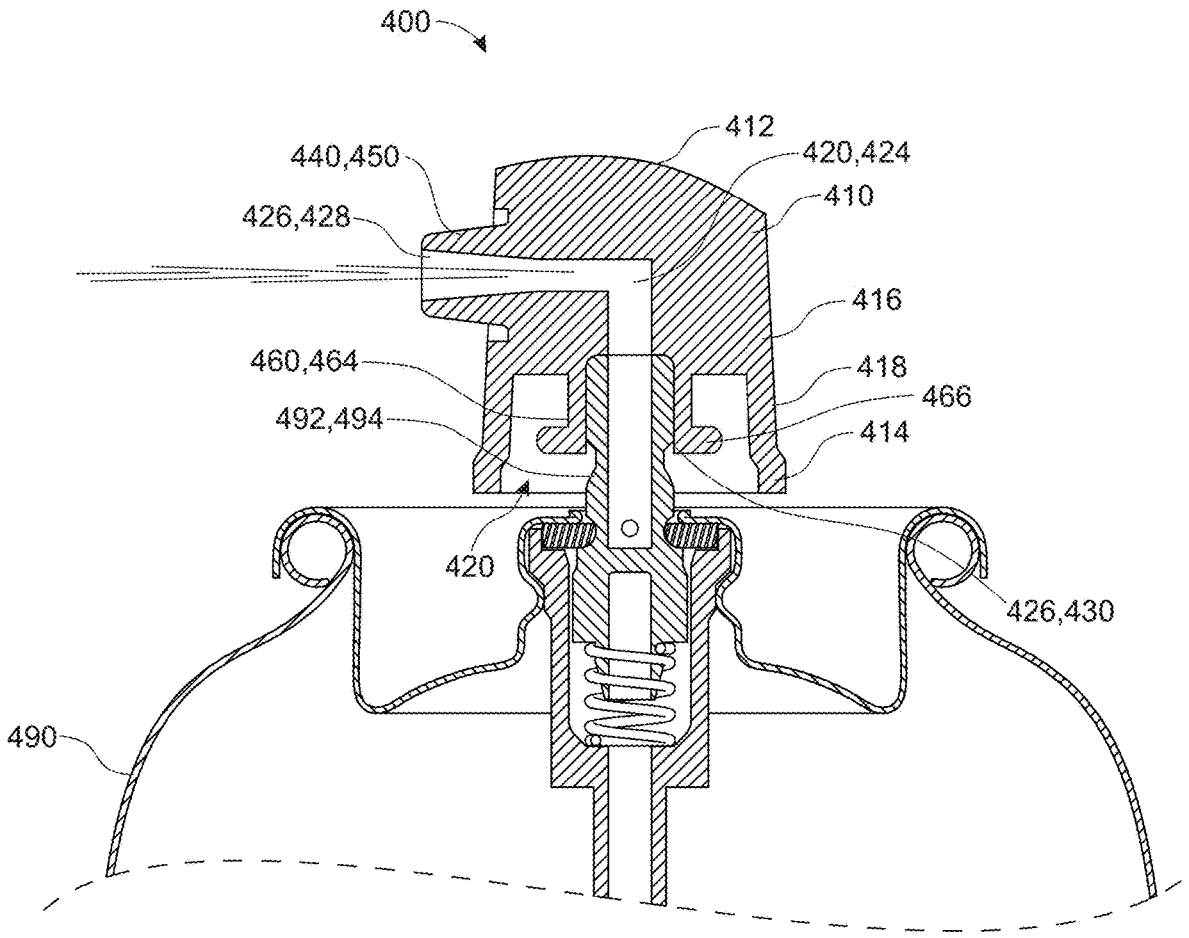
FIG. 6 presents a side cross-section view of a removable spray can button as in FIG. 4B, with the removable spray can button installed on a representative spray can.

Referring next to FIG. 4B, a right perspective view and a front right bottom perspective view are provided of a removable spray can button, hereinafter button 400, in accordance with a fourth illustrative embodiment of the present invention. FIG. 6 presents a side cross-section view of a removable spray can button as in FIG. 4B, with the removable spray can button installed on a representative spray can. The button 400 is configured for use on a pressurized spray can (as seen at FIG. 6, elements 490,494). Reference numerals which correspond to like elements of the button 100 heretofore described with respect to FIGS. 1A and 2, the button 200 heretofore described with respect to FIGS. 1B and 3, and the button 300 heretofore described with respect to FIGS. 4A and 5, are designated by the same reference numerals in the 400-499 series in FIGS. 4B and 6.

The button 400 comprises a spray can button body 410 having a top 412, a bottom 414, at least one side wall 416, an exterior surface 418, and an interior portion 420 comprising a tapered interior lumen 424 and at least one tapered orifice 426 comprising a first upper tapered orifice 428 and a second lower tapered orifice 430. The first and second tapered orifices 428,430 are in fluid communication with the tapered interior lumen 424, with the tapered interior lumen 424 extending therebetween. The at least one side wall may be any suitable number of side walls, as the geometric shape may be any suitable shape. The at least one side wall shown is one cylindrical side wall.

The removable spray can button 400 comprises an improved nozzle 440 configured to provide a direct pinpoint spray; an integral hose adapter 450 defined by the first tapered orifice configured to receive and securely retain a spray hose; and an integral stem connector 460 carried by and extending outward from the button body 410.

The first upper tapered orifice 428 terminates in and is integral with the improved nozzle 440.

The integral stem connector 460 comprises and is integral with the second lower tapered orifice 430 configured for connection to a pressurized spray can. The spray can button 400 is configured for installation on an aerosol can 490 at a top center area 492 on an exit valve 494 of the aerosol can 490 as shown at FIG. 6. The integral stem connector 460 of the button 400 comprises a hollow tubular stem 464 configured to be installed over the exit valve 494 to install the button 400. The hollow tubular stem 464 further comprises an exterior donut shaped protrusion 466, which may serve as a stem support to stabilize the stem 462 and hold it in place during use of the pressurized spray can 490. In use, the donut-shaped protrusion 466 is proximal to where the stem meets the valve 494 makes it less likely that the stem 462 will break off at that junction in response to too much horizontal force being accidentally applied to the button 400, or when the can 490 on which the button 400 is installed accidentally falls or is accidentally dropped.

The button 400 is configured for use to provide a to provide a targeted spray. Optionally, the button 400 may be used with a hose accessory, which may be inserted in the tapered orifice 428 and securely held therein (as is shown in FIG. 5 wherein a hose accessory 398 has been inserted in the tapered orifice 328 and is being securely held therein).

Figure 7A:
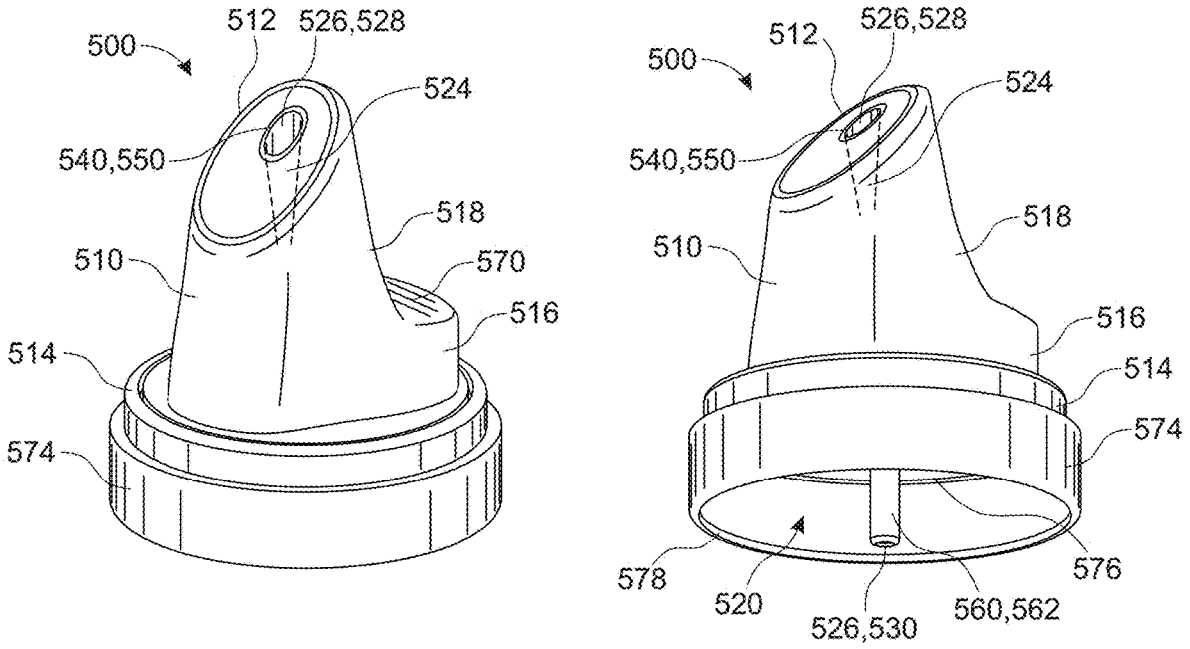
FIG. 7A presents a front right perspective view and a front right bottom perspective view of a removable spray can button in accordance with a fifth illustrative embodiment of the present invention.
Figure 8:
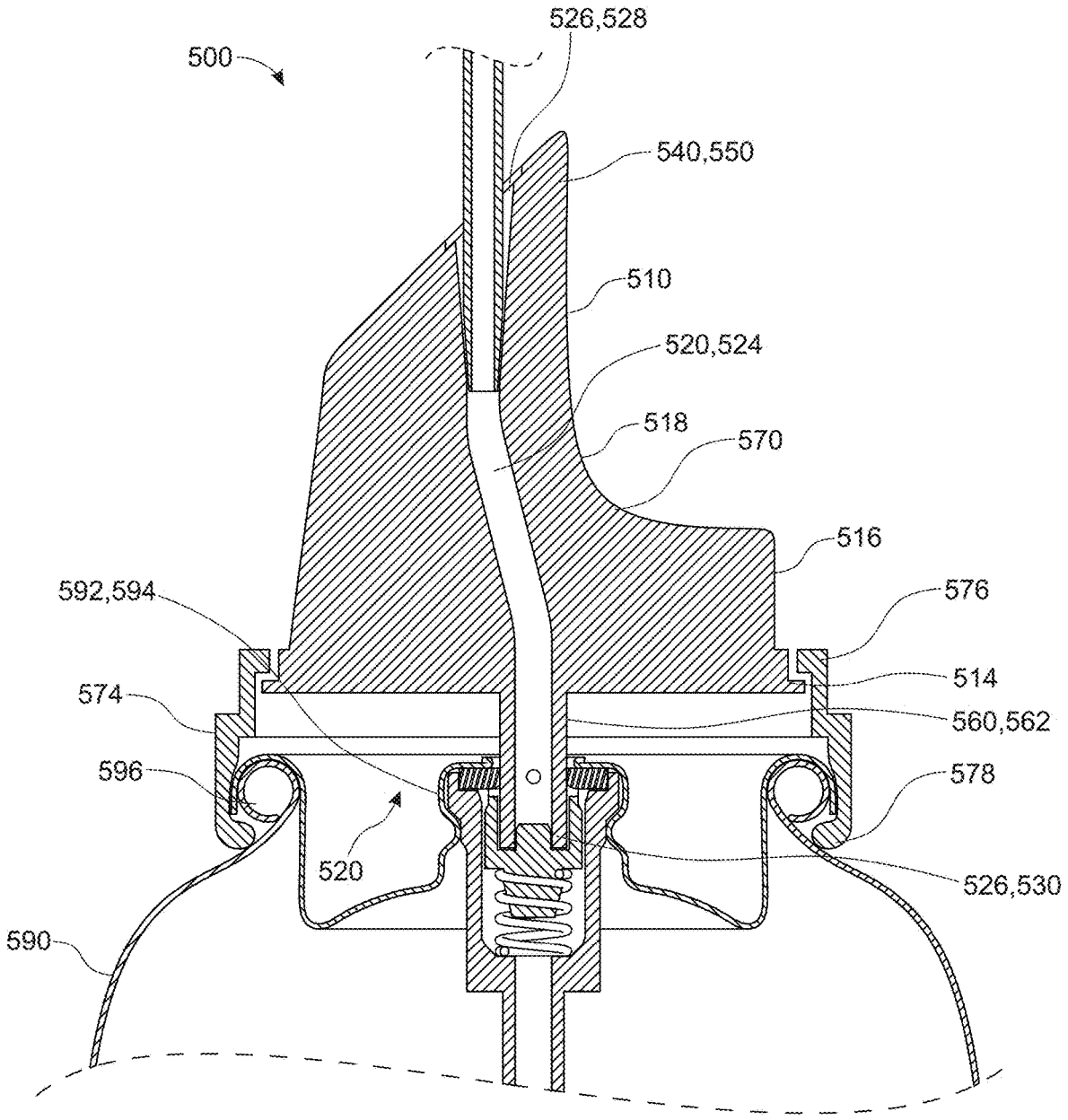
FIG. 8 presents a side cross-section view of a removable spray can button as in FIG. 7A, with the removable spray can button installed on a representative spray can, and showing an optional hose accessory installed therein.

Referring now to FIG. 7A, a front right perspective view and a front right bottom perspective view of a removable spray can button, hereinafter button 500, in accordance with a fifth illustrative embodiment of the present invention. FIG. 8 presents a side cross-section view of a removable spray can button as in FIG. 7A, with the removable spray can button installed on a representative spray can, and showing an optional hose accessory installed therein. The button 500 is configured for use on a pressurized spray can (as seen at FIG. 8, elements 590,594). Reference numerals which correspond to like elements of the button 100 heretofore described with respect to FIGS. 1A and 2, the button 200 heretofore described with respect to FIGS. 1B and 3, the button 300 heretofore described with respect to FIGS. 4A and 5, and the button 400 heretofore described with respect to FIGS. 4B and 6, are designated by the same reference numerals in the 500-599 series in FIGS. 7A and 8.

The button 500 comprises a spray can button body 510 having a top 512, a bottom 514, at least one side wall 516, an exterior surface 518, and an interior portion 520 comprising a tapered interior lumen 524 and at least one tapered orifice 526 comprising a first upper tapered orifice 528 and a second lower tapered orifice 530. The first and second tapered orifices 528,530 are in fluid communication with the tapered interior lumen 524, with the tapered interior lumen 524 extending therebetween.

The at least one side wall may be any suitable number of side walls, as the geometric shape may be any suitable shape. The at least one side wall shown has an ergonomic shape with a larger lower portion tapering inward to a relatively smaller upper portion. The shape of the at least one side wall includes a wide cupped ergonomic depression 570 configured to comfortably receive and support a user's finger when the button 500 is depressed. The button 500 further comprises a retention collar 574 configured to snap fit over an upper rim 596 of a spray can 590.

The removable spray can button 500 comprises an improved nozzle 540 configured to provide a direct pinpoint spray; an integral hose adapter 550 defined by the first tapered orifice configured to receive and securely retain a spray hose; and an integral stem connector 560 carried by and extending outward from the button body 510.

The first upper tapered orifice 528 terminates in and is integral with the improved nozzle 540.

The integral stem connector 560 comprises and is integral with the second lower tapered orifice 530 configured for connection to a pressurized spray can. The spray can button 500 is configured for installation on an aerosol can 590 at a top center area 592 on an exit valve 594 of the aerosol can 590 as shown at FIG. 8. The integral stem connector 560 of the button 500 comprises an elongated stem 562 configured to be inserted in the exit valve 594 to install the button 500. The retention collar 574 comprises an upper flange 576 which extends over the bottom 514 of the button body 510 and is configured to retain the button body 510 in place. The retention collar 574 further comprises a lower rim 578 configured to snap fit over the spray can upper rim 596 to further secure the button body 510 in place on the spray can 590. In use, the retention collar 570 permits the button body 510 to be depressed while stabilizing the button body 510 to prevent damage to the can exit valve 594.

The button 500 is configured for use to provide a to provide a targeted spray. Optionally, the button 500 may be used with a hose accessory 598, which may be inserted in the tapered orifice 528 and securely held therein.

Figure 7B:
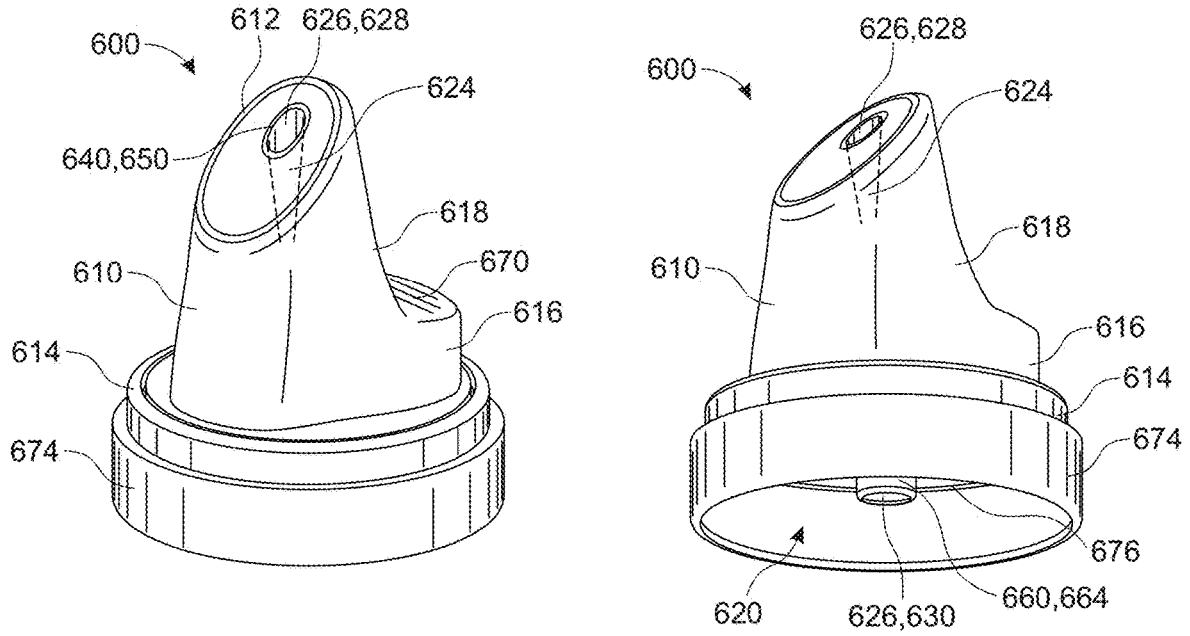
FIG. 7B presents a front right perspective view and a front right bottom perspective view of a removable spray can button in accordance with a sixth illustrative embodiment of the present invention.
Figure 9:
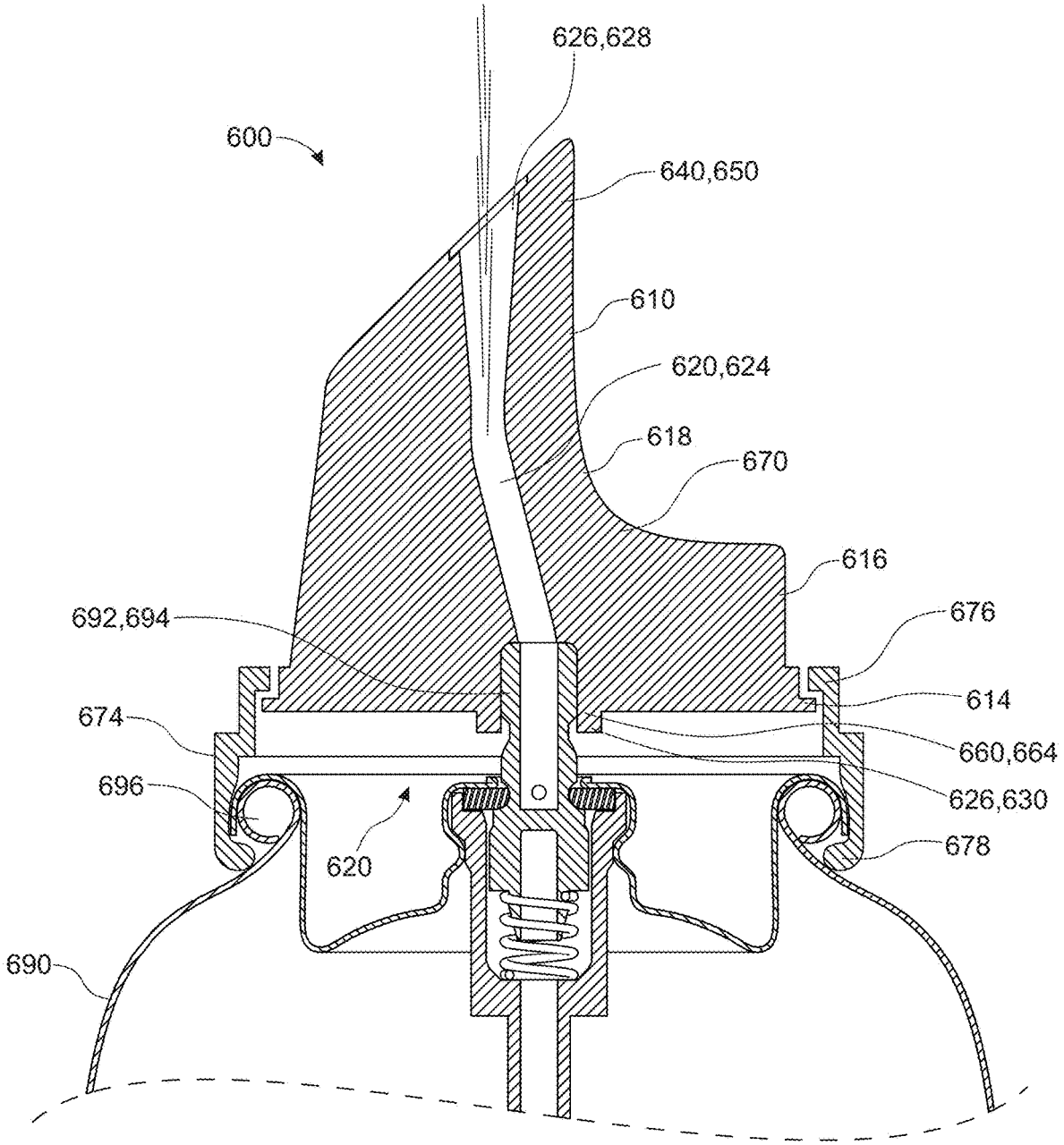
FIG. 9 presents a side cross-section view of a removable spray can button as in FIG. 7B, with the removable spray can button installed on a representative spray can.

Referring now to FIG. 7B, a front right perspective view and a front right bottom perspective view of a removable spray can button are shown of a removable spray can button 600 in accordance with a sixth illustrative embodiment of the present invention. FIG. 9 presents a side cross-section view of a removable spray can button as in FIG. 7B, with the removable spray can button installed on a representative spray can. Reference numerals which correspond to like elements of the button 100 heretofore described with respect to FIGS. 1A and 2, the button 200 heretofore described with respect to FIGS. 1B and 3, the button 300 heretofore described with respect to FIGS. 4A and 5, the button 400 heretofore described with respect to FIGS. 4B and 6, and the button 500 heretofore described with respect to FIGS. 7A and 8, are designated by the same reference numerals in the 600-699 series in FIGS. 7B and 9.

The button 600 is configured for use on a pressurized spray can (as seen at FIG. 9, elements 690,694). The button 600 may be used with an optional hose accessory (as is shown at FIG. 8, elements 598).

The button 600 comprises a spray can button body 610 having a top 612, a bottom 614, at least one side wall 616, an exterior surface 618, and an interior portion 620 comprising a tapered interior lumen 624 and at least one tapered orifice 626 comprising a first upper tapered orifice 628 and a second lower tapered orifice 630. The first and second tapered orifices 628,630 are in fluid communication with the tapered interior lumen 624, with the tapered interior lumen 624 extending therebetween.

The at least one side wall may be any suitable number of side walls, as the geometric shape may be any suitable shape. The at least one side wall shown has an ergonomic shape with a larger lower portion tapering inward to a relatively smaller upper portion. The shape of the at least one side wall includes a wide cupped ergonomic depression 670 configured to comfortably receive and support a user's finger when the button 600 is depressed. The button 600 further comprises a retention collar 670 configured to snap fit over an upper rim 696 of a spray can 690. The collar 670 further secures the button body 610 in place on the spray can 690.

The removable spray can button 600 comprises an improved nozzle 640 configured to provide a direct pinpoint spray; an integral hose adapter 650 defined by the first tapered orifice configured to receive and securely retain a spray hose; and an integral stem connector 660 carried by and extending outward from the button body 610.

The first upper tapered orifice 628 terminates in and is integral with the improved nozzle 640.

The integral stem connector 660 comprises and is integral with the second lower tapered orifice 630 configured for connection to a pressurized spray can. The spray can button 600 is configured for installation on an aerosol can 690 at a top center area 692 on an exit valve 694 of the aerosol can 690 as shown at FIG. 9. The integral stem connector 660 of the button 600 comprises a hollow tubular stem 664 configured to be installed over the exit valve 694 to install the button 600. The retention collar 674 comprises an upper flange 676 which extends over the bottom 614 of the button body 610 and is configured to retain the button body 610 in place. The retention collar 674 further comprises a lower rim 678 configured to snap fit over the spray can upper rim 696 to further secure the button body 610 in place on the spray can 690. In use, the retention collar 670 permits the button body 610 to be depressed while stabilizing the button body 610 to prevent damage to the can exit valve 694.

The button 600 is configured for use to provide a to provide a targeted spray. Optionally, the button 600 may be used with a hose accessory 698, which may be inserted in the tapered orifice 628 and securely held therein.

The novel spray can buttons of the present invention are configured for removable installation on conventional pressurized spray cans. The spray can buttons may be used as a replacement spray can button with products such as WD-40 brand spray lubricant, Liquid Wrench brand lubricant, any other similar spray lubricant, or like spray product which may require or benefit from a targeted spray.

Advantages of the spray can button nozzle of the present invention over standard spray buttons are many. Such advantages include an integral pin-point spray nozzle which does not require a hose accessory for direct application. The spray can button of the present invention has an improved nozzle which provides a direct pin-point spray. The spray can button does not require a straw or hose accessory to provide a pin-point spray. However, the user may, if desired, securely attach a hose accessory for use, and be assured the hose accessory will remain in place during use. The tapered orifice of the novel button of the present invention will accommodate the hose accessory for a longer reach. The button of the present invention solves the problem of previous spray buttons being complicated and messy to use. In situations wherein the accessory hose is used, the button of the present invention prevents the accessory hose from falling out.

The spray button(s) of the present invention are configured for installation at the top center of an aerosol can in the same place the buttons are presently located, and may easily be installed to replace an existing button.

The spray button(s) of the present invention or portions thereof may be injection molded. In some embodiments, the spray button may be one integral piece. In other embodiments, portions of the spray button may be injection molded.

The spray button of the present invention may be manufactured to accommodate the same size stem or orifice that now exists on various products.

The spray button of the present invention may be used by the aerosol companies and/or by a consumer to replace the spray button that currently comes with the product.

No electrical components are required for operation or use of the spray buttons of the present invention.

A removable spray can button configured for removable placement on a pressurized spray can. The removable spray can button comprises an integral stem, an integral hose adapter and an improved nozzle. The spray can button may be used as a replacement spray can button with any suitable spray product, including but not limited to spray lubricants or the like. The improved nozzle comprises an integral pin-point spray nozzle capable of providing a direct pin-point spray without the need of a straw, such as the red hose provided with many spray lubricants for a direct pin-point spray. The spray can button may include a tapered orifice and a tapered interior lumen. The tapered orifice and tapered lumen may beneficially be used to securely hold a hose accessory. If the user needs a longer reach, the standard red hose may be more securely attached to the spray can nozzle by insertion into the tapered orifice and will not fall out during use. The spray button of the present invention may be installed at the top center of an aerosol can in the same place the existing button is presently located. The spray button of the present invention may be injection molded. The spray button of the present invention may be manufactured to accommodate the same size stem or orifice that now exists on various spray products. The spray button of the present invention may be used by the aerosol companies and/or by a consumer to replace the spray button that currently comes with spray products.

Alternative embodiments are contemplated in which one or more components are provided as separate components which may be assembled, inserted, and permanently held in the spray can button body, i.e., a hollow tubular button body having at least one portion, with a separate attachable top, and separate interior lumen, nozzle, hose adapter and stem connector. The elements or components of the spray can button may be made of any suitable materials, which may be polymeric materials, with or without additives. Separate components may comprise metals or alloys. The elements or components of the spray can button may be fabricated by any suitable process, including injection molding, 3D printing or additive manufacturing, casting, or the like.

In summary, a removable spray can button for use on a pressurized spray can, the spray can button comprises a spray can button body having a top, a bottom, at least one side wall, an exterior surface, and an interior portion comprising a tapered interior lumen and at least one tapered orifice comprising a first upper tapered orifice and a second lower tapered orifice. The removable spray can button comprises an improved nozzle configured to provide a direct pinpoint spray; an integral hose adapter defined by the first tapered orifice configured to receive and securely retain a spray hose; and an integral stem connector carried by and extending outward from the button body. The integral stem connector comprises the second lower tapered orifice configured for connection to a pressurized spray can. The first upper tapered orifice terminates in the improved nozzle. The spray can button is configured for installation at a top center area of an aerosol can in place of an existing aerosol can button to provide a targeted spray.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

What is claimed is:

1. A removable spray can button for use on a pressurized spray can, the spray can button comprising:

a spray can button body having a top, a bottom, at least one side wall, an exterior surface, and an interior portion comprising a tapered interior lumen and at least one tapered orifice comprising a first upper tapered orifice and a second lower tapered orifice;

an improved nozzle configured to provide a direct pinpoint spray;

an integral hose adapter defined by the first tapered orifice configured to receive and securely retain a spray hose; and an integral stem connector carried by and not extending outward from the button body, the integral stem connector comprising the second lower tapered orifice configured for connection to a pressurized spray can;

wherein the first upper tapered orifice terminates in the improved nozzle;

wherein the spray can button is configured for installation at a top center area of the pressurized spray can in place of an existing pressurized spray can button to provide a targeted spray; and wherein a distal portion of the tapered interior lumen widens progressively downstream from the targeted spray.

2. The removable spray can button of claim 1, wherein the integral stem connector comprises a hollow stem configured to be installed over an exit valve of the spray can to install the button; and wherein the tapered interior lumen extends beyond a widest point of the spray can button body.

3. A pressurized spray can comprising the removable spray can button of claim 1 removably placed thereon.

4. The pressurized spray can of claim 3, wherein the removable spray can button is placed at a top center area on an exit valve of the pressurized spray can.

5. The removable spray can button of claim 1 in the absence of any electrical component.

* * * * *